United States Patent [19]

Piper

[11] Patent Number: 4,479,459

[45] Date of Patent: Oct. 30, 1984

[54] SEQUENCING BLOW DOWN VALVE MECHANISM

[75] Inventor: Jack R. Piper, Mount Prospect, Ill.

[73] Assignee: International Telephone and Telegraph Corporation, New York, N.Y.

[21] Appl. No.: 397,685

[22] Filed: Jul. 13, 1982

[51] Int. Cl.[3] ..... F22B 37/48; F28G 9/00; F16K 31/04

[52] U.S. Cl. ..... 122/379; 122/388; 122/402; 251/134; 251/297; 137/625.47; 137/556.6

[58] Field of Search ..... 122/379, 381, 399, 388, 122/402, 390, 404, 392, 405, 396; 137/625.22, 625.47, 556.6; 251/134, 297

[56] References Cited

U.S. PATENT DOCUMENTS

| | | | |
|---|---|---|---|
| 615,881 | 12/1898 | McIntoch | 122/381 |
| 903,931 | 11/1908 | Wiemann | 122/402 |
| 1,696,005 | 12/1928 | Kothe | 122/405 |
| 2,229,933 | 1/1941 | Parker | 137/625.22 |
| 2,868,176 | 1/1959 | Bennett | 137/625.22 |
| 3,299,904 | 1/1967 | Burke | 137/556.6 |
| 3,524,526 | 8/1970 | Denkowski | 251/134 |
| 3,794,293 | 2/1974 | Matuda | 251/134 |
| 3,834,372 | 9/1974 | Turney | 137/625.47 |
| 3,900,010 | 8/1975 | Stiteler et al. | 122/379 |
| 4,207,923 | 6/1980 | Giurtino | 137/635.47 |
| 4,261,300 | 4/1981 | Cross et al. | 122/388 |
| 4,342,335 | 8/1982 | Reinicker et al. | 251/297 |
| 4,355,659 | 10/1982 | Kelchner | 136/625.47 |
| 4,361,308 | 11/1982 | Buss | 251/134 |

*Primary Examiner*—Henry C. Yuen

*Attorney, Agent, or Firm*—James B. Raden; Marvin M. Chaban

[57] ABSTRACT

A sequencing blow down or blow off valve mechanism for the low water cut off and/or water column of the equalizing piping network of a steam boiler. The valve mechanism is located at the junction of the vertical cut off outlet pipe, the lower horizontal pipe to the boiler and the vertical drain line. The valve mechanism normally rests in a position completing the network while blocking the drain line. The valve mechanism may be moved to successive positions completing drain paths from the lines of the network to the drain line. Whenever the valve mechanism is out of the normal position, the fuel supply to the boiler is shut off to prevent boiler firing. The valve mechanism provides a visual indication of the valve position. Further the valve mechanism allows access to the network lines for cleaning and/or rodding of the lines whenever the valve mechanism is in any of the successive positions. Manual and automatic operation are disclosed.

8 Claims, 15 Drawing Figures

SEQUENCING BLOW DOWN VALVE MECHANISM

BACKGROUND OF THE INVENTION

In boiler systems known heretofore having a low water cut off control and/or water column in an equalizing piping network, a drain pipe is provided from the junction of the low water cut off outlet pipe (or column) to the lower horizontal pipe. A valve in the drain line outside the network is provided for cleaning and blow down of the lines. The junctions of lines in the systems are provided with cross plugs to enable cleaning and rodding of the lines. The major drawback of this approach is that, the valve does not allow for individual blow down of the lines for thorough cleaning of each line. Further, ASME standards require that the blow down valve be placed outside the equalizing network to insure that the low water cut off network is inactivated by an inadvertantly closed valve which could occur in the blow down process. Further it is required that each junction of piping in the network provide access to the lines of the network for rodding and cleaning.

SUMMARY OF THE INVENTION

In order that a blow down valve mechanism be allowed to be placed within the equalizing piping network for a water column or low water cut off boiler system, various safe guards must be provided. First, any time the valve mechanism provides any blockage or discontinuity of the equalizing network, the fuel supply system must be shut off. Visual indications of the conditions of the valve mechanism must be provided for all conditions. The valve mechanism must be readily operable to drain the network. Further, the valve mechanism must have structure which allows access to the horizontal line and vertical line from the cut off device to allow rodding and cleaning of the lines. The mechanism must be structured so that it cannot be reassembled in any wrong condition which could lead to displacement of the valve positions.

To meet these requirements, the present invention provides a valve mechanism at the junction or cross plug fitting between the vertical outlet pipe from the low water cut off device, and/or water column and the horizontal pipe. The valve mechanism allows blowdown of the equalizing piping on a pipe or line by line basis. The valve also allows access to the lines for rodding and the like. Once the valve is moved from the normal condition, the feed to the boiler is caused to be shut off and maintained in the off condition until the valve is restored to its normal operative condition.

Further the valve has means for setting the valve into its respective blow down positions and maintaining the valve in those conditions. Visual position indications are provided for each position.

The mechanism may be provided in a manually controlled form. In this form, a handle accessible from the exterior of the valve mechanism may be rotated to rotate the valve from the normal operative position successively to each of the blow down positions. A switch mechanism is operated by the handle to deenergize the fuel supply to the boiler heating system as soon as the valve leaves the normal position and maintains the supply inoperative as long as the valve remains out of the normal position. In each blow down position, a detent or rachet mechanism sets and maintains the valve mechanism in the position for blow down or clean out.

In an automatically controlled mode, a motor driven valve mechanism is provided, the control being through use of a timing and control circuit. The circuit sequences the valve mechanism through cycles including successive 90° movements with a time delay or dwell at the respective blow down positions. A visual indicator and shut off interlocks operative on the movement off normal and out of the respective blow down positions are provided.

For either manual or automatic mode, a ball valve structure with a tee shaped passage is situated at the junction of outlet of the low water cut off mechanism pipe or water column and the horizontal line with the ports of the tee passage alignable with the respective lines and a vertical drain line. The ball is sealed in this junction with combined sealing and bearing rings surrounding each of the tee ports and surrounding the fourth possible port position through a cross opening normally sealed off by a removable plug fitting.

DETAILED EXPLANATION

Figure 1:
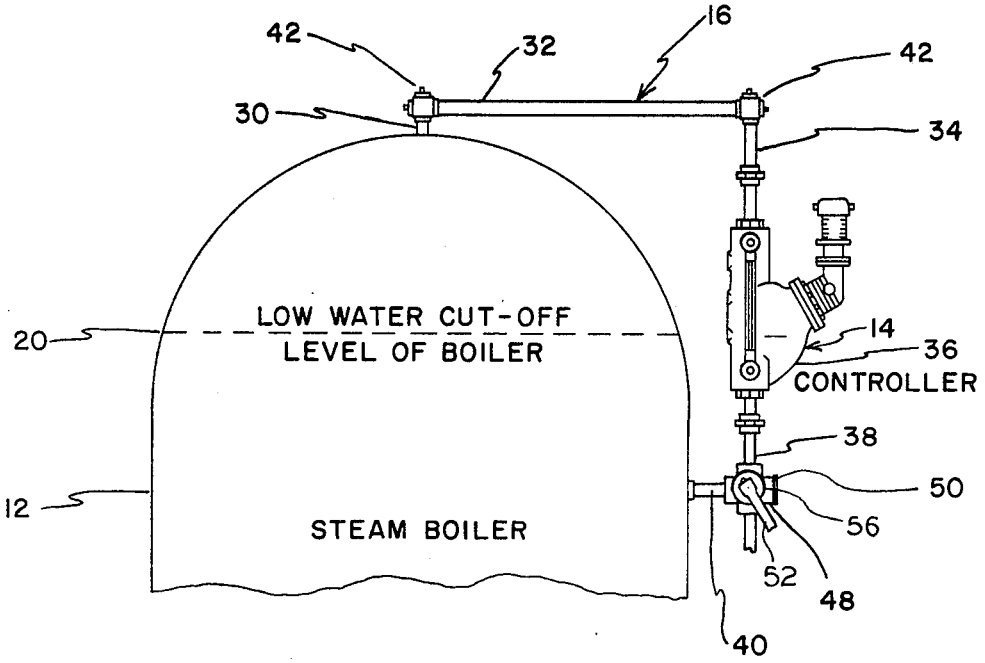
FIG. 1 is a schematic diagram of the equalizing piping network of a steam boiler employing the present invention in its manual form.

In FIG. 1, is shown diagrammatically a conventional steam boiler 12 with an external low lever water cut off (CO) control 14 in an equalizing piping network 16 external to the boiler 12. Preferably, the boiler is of the automatically fired type. Although not shown as such, the equalizing network may employ a glass water column along in the network or in combination with a water cut off control.

In the boiler 12, there is a water level indicated by the dashed line 20 with water below the line and steam above. This water line would be the level at which the low water cut off control 14 operates to shut off the heating control or fuel supply for the boiler as is well-known.

The ASME Code for Low Pressure Heating Boilers specifies:

> "Each automatically fired steam or vapor-system boiler shall be equipped with an automatic low-water fuel cut-off so located as to automatically cut off the fuel supply when the surface of the water falls to the lowest safe waterline. If a water feeding device is installed, it shall be so constructed that the water inlet valve cannot feed water into the boiler through the float chamber and so located as to supply requisite feed-water. The lowest water line should be not lower than the lowest visible part of the water glass."

The equalizing network is fed from an opening in the dome of the boiler leading to a steam pipe 30 of short vertical extent. The input to the cut off (CO) control from pipe 30 includes a horizontal steam pipe 32 leading in turn to a vertical inlet pipe 34 descending to the controller 14. The controller may be any suitable control such as float control and may include normal feed pump control in addition to the low water cut off control and also may include alarm switching. Such controls are well-known in the art and may include probe type controls as shown by U.S. Pat. No. 4,263,587 to R. S. John issued Apr. 21, 1981.

The level control cut off (CO) of either type is encased in an enclosing housing 36 suitable for operation at elevated pressures of steam; a suitable one of such CO control apparatus is sold by ITT McDonnell & Miller under the model number #193 or #194. The output of the CO control is a descending vertical pipe 38 connected to a horisontal or water equalizing pipe 40 reentering the boiler below the normal and low water levels.

As required by ASME specification, the junctions 42 of the pipes in the network are fitted with cross plugs to enable the lines to be opened for cleaning and/or rodding. As is customary the piping of this network employs pipe of 1" I.D. minimum.

Figure 2:
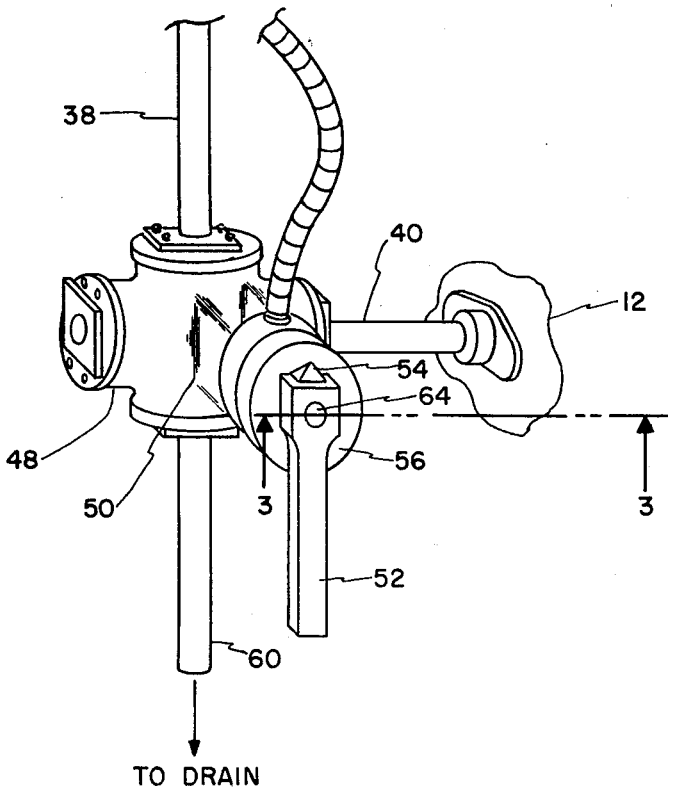
FIG. 2 is a side view in perspective of a valve mechanism as shown in FIG. 1.

At the junction 48 of CO outlet pipe 38 and water reentry pipe 40 is mounted the valve mechanism 50 of the present invention. As seen in FIGS. 1 and 2, the mechanism 50 has its valve operating apparatus extending from the junction and terminating a manually rotatable handle 52. The handle 50 is shown in the normal position which allows communication between the CO outlet pipe 38 and the boiler water horizontal pipe 40. In the normal position, the pointer extension 54 of handle 52 points vertically upward toward the operating position marking indicia on the valve mechanism face plate 56.

Also as can be seen in FIGS. 1 and 2, there is a drain or blow down pipe 60 extending downwardly from the body of valve mechanism 50. The drain pipe at its bottom end is connected to a drain to allow drainage or blow off in positions other than the normal position of FIGS. 1 and 2. In the normal position, the path from the piping network 16 to the drain line is closed.

Figure 3:
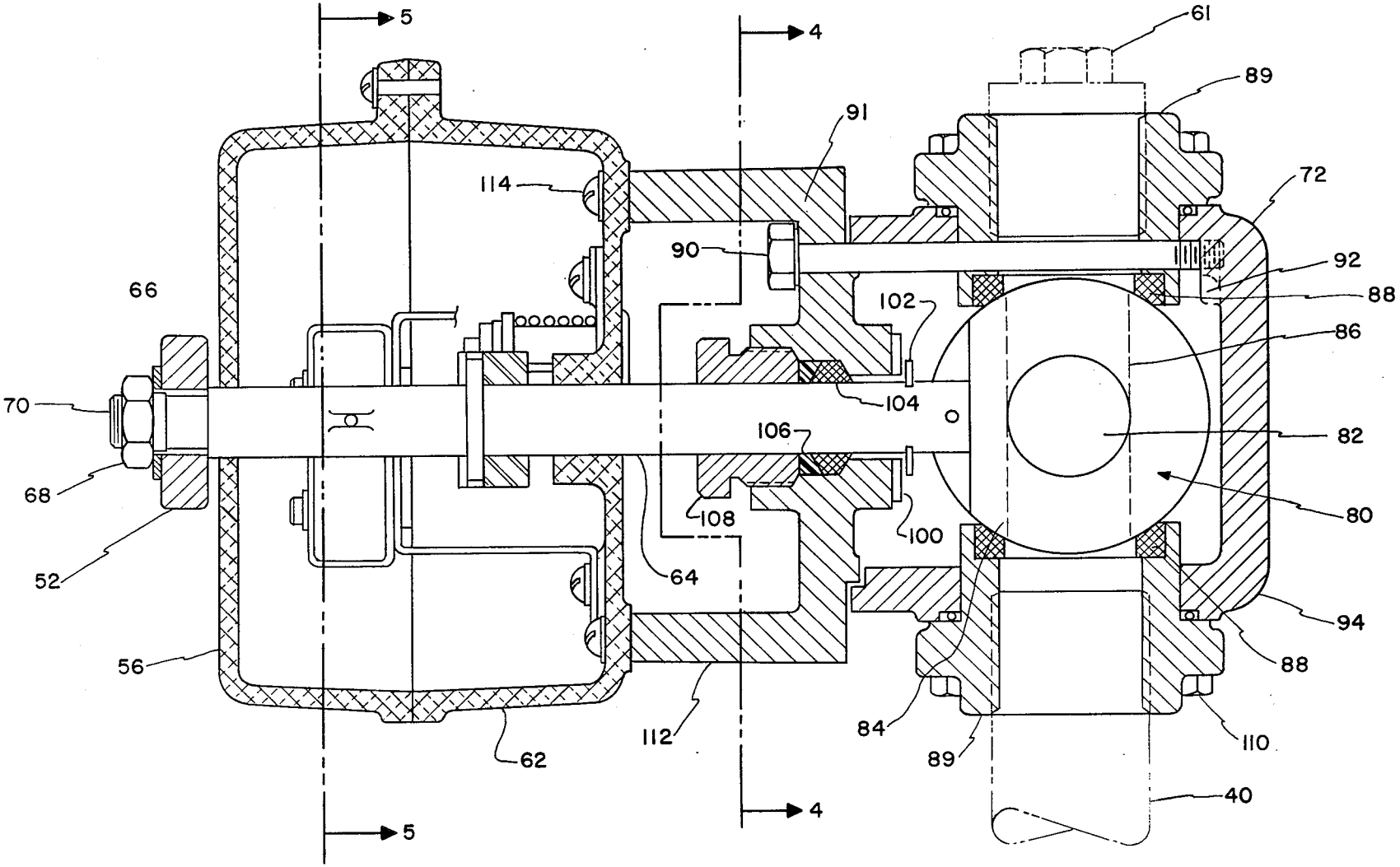
FIG. 3 is an end view of the valve mechanism of FIGS. 1 and 2.

In FIG. 3, is shown the valve mechanism 50 of the invention in greater detail. In this Figure the piping network such as pipe 40 is shown in dashed lines along with the cross plug 61. For proper orientation of FIG. 3, the face plate 56 is either stamped or mounted on the face of electrical enclosure 62 with the handle 52 external to the enclosure 62 and mounted on shaft 64 for rotation therewith.

The shaft 64 is keyed to the handle 52 by the use of mating flats 66 which enable the handle to be mounted on the shaft in one way only. The handle is affixed to the shaft by the use of a nut 68 secured on the threaded end portion 70 of the shaft 64. The shaft extends from its exposed outer (threaded end portion 70) through an intermediate area within electrical enclosure 62 to the valve end within an enclosing valve housing 72. The valve housing is constructed of ductile iron to withstand working pressure of 250 psi and 406° F. At the shaft end within the housing there are flats formed on the shaft wall. These flats fit in a slot in which the shaft is pinned to the ball valve 80 in a manner allowing assembly in only one relationship. The ball valve 80 is a spherical ball having a tee shaped passage therethrough, the passage passing through the center of the ball. Shown in FIG. 3, is the port 82 which in the valve normal position extends vertically upwardly to communicate with the CO outlet pipe 38. Shown in dashed lines are the side ports 84 and 86 which communicate respectively with reentry pipe 40 and normally closed cross plug 61.

The ball is preferably fabricated of stainless steel (316 ss has been found acceptable) although various plastics and carbon may be used, the operating temperatures and pressures of the steam boiler determining the plastics which could be used.

Since the pipes used have a minimum inner diameter of 1", the diameter of the ports of the system is 1" also.

The ball rests in combination bearings and annular seals 88 which surround each opening or port in the valve housing. There are four such ports in the valve housing, one directed up for securement to the CO outlet pipe, one down to the drain or blow off pipe, and two sidewise ones to the reentry pipe and to the cross plug respectively. Thus, the ball rests on an annular seal seen in FIGS. 6–9 surrounding the drain pipe port with the other three annular seals confining the ball in the junction of the valve housing. These seals are preferably of glass filled Teflon or other lubricious plastic capable of withstanding the temperatures and pressures of the boiler network.

For assembly of the ball in the valve housing, the valve is positioned between two opposing end caps 89 of the housing while the external mounting bolts are tightened. The bolts are tightened evenly on the valve caps while the ball is rotated to prevent binding of the ball. The two remaining valve caps are assembled and tightened in the same way with the ball checked to prevent binding. After this assembly, the packing gland 108 is tightened while the valve shaft or stem is rotated to ensure that no binding occurs and that the shaft is free to rotate.

Figure 4:
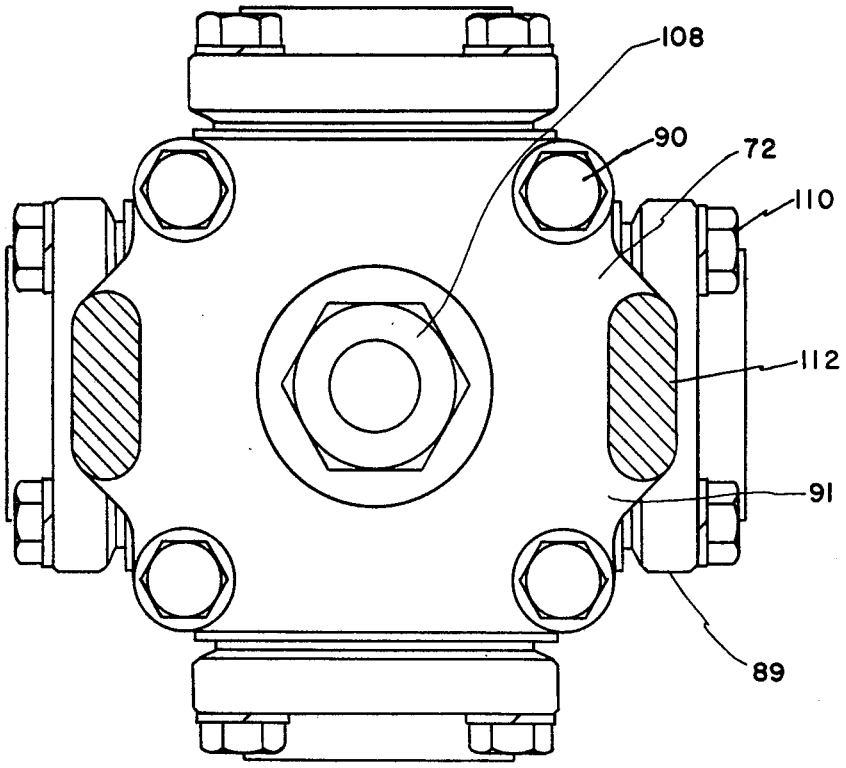
FIG. 4 is a sectional view along line 4—4 of FIG. 3.
Figure 5:
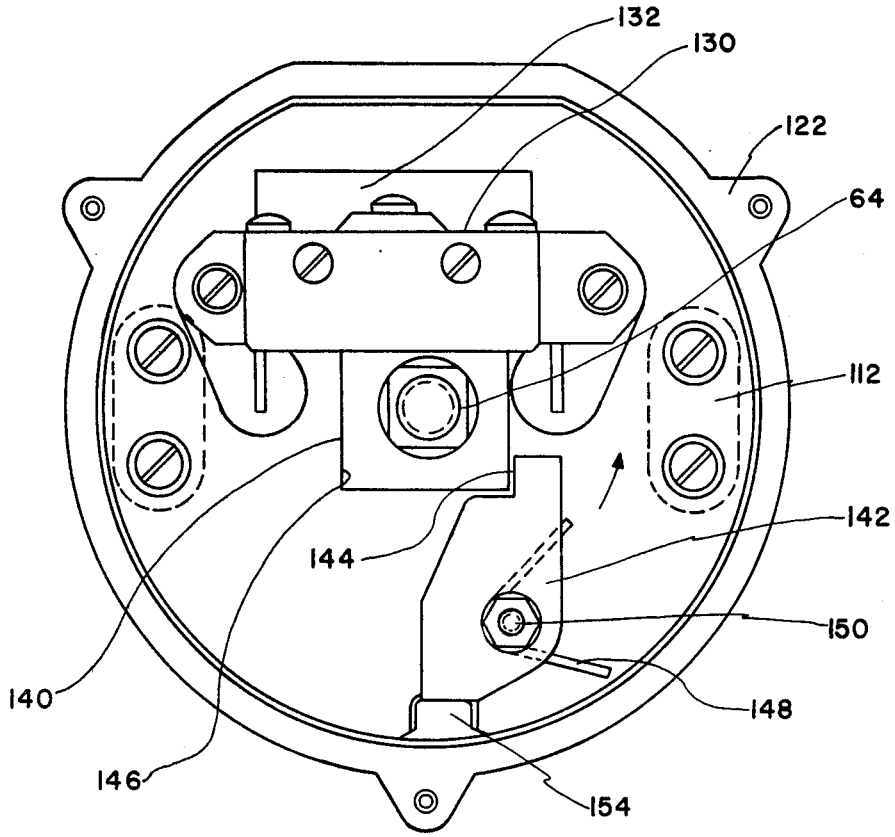
FIG. 5 is a section view along line 5—5 of FIG. 4.

Viewing the valve structure and housing of FIGS. 3 and 4, there are four bolts 90 parallel to the shaft 64 which extend through the valve cover 91 and are threaded into the bosse 92 of the back wall 94 of the valve structure. Other bolts 110 secure the end caps 89, as described previously.

Along the shaft, the valve body or housing is sealed by a retainer or thrust washer 100 captured between the adjacent wall of the valve cover 91 and a key 102 pinned to the shaft. The cover has a nest for a circular ring of packing 104 and a keeper ring 106 under a packing gland nut 108 threaded onto the shaft cover.

By the use of the bolts 90, the valve body is tightened and by the gland nut and packing the shaft is sealed. The end caps for the piping and cross plugs are bolted to the body of the valve by bolts 110, as can be seen best in FIG. 4.

The cover of the valve body has two U shaped arms 112 of oval cross section with threaded blind openings to which the electrical and camming enclosure 62 is mounted by screws 114. The enclosure 62 is formed of two sections joined by three screws 120. The screws may be self tapping and are fitted through outwardly extending ears 122. The enclosure houses the limit switch 130 for sensing off-normal movement and the mechanical arrangement for limiting the movement to 90° steps.

Figure 12:
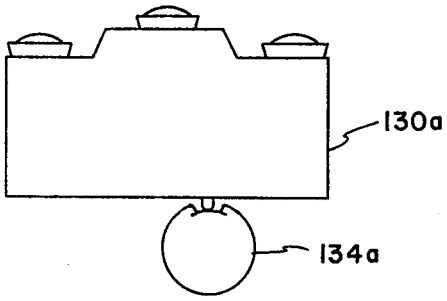
FIGS. 12 and 13 show schematic drawings of two embodiments of off-normal or limit switches usable herein.
Figure 13:
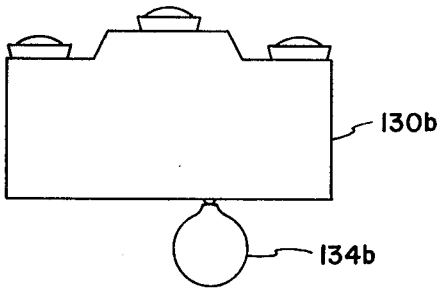

The limit switch 130 is a commercial switch mechanism procurable off the shelf, the switch being mounted on bracket 132 secured to the enclosure. Keyed to the shaft is a cam which may be in either the inset version 134*a* shown in FIG. 12 or the external tab 134*b* shown in FIG. 13. In either case, the switch is in its normal position as shown in these figures to indicate that condition. When the shaft steps the cam 104 from the normal position, the switch operates to provide a shut off for fuel supply to the boiler and/or shuts off the burner to which the fuel is supplied. The switch remains operated until the normal position is again reached.

To properly index or ratchet the shaft 64 to 90° of rotation, a square cam 140 is secured to the shaft 64 for rotation with the shaft. A spring loaded detent 142 is pivotally secured on the floor of enclosure 62. The detent 142 has an indentation 144 for mating with the corners 146 of the square cam. A torsion spring 148 mounted on the pivotal axis 150 of the detent and has one arm 152 bearing against the wall of enclosure 62 to restore the detent to its normal position after a corner of the cam has passed the detent. A flatted boss 154 on the wall of the housing maintains the detent in its normal position when the detent abuts the tab. The shaft 64 can only be rotated in the direction of the arrow, in which case the cam spring yeilds and allows the corner of the cam to pass the tip of the detent. The detent restores and will capture the next corner within indentation 144 and hold the cam and the shaft in the 90° position.

Figure 6:
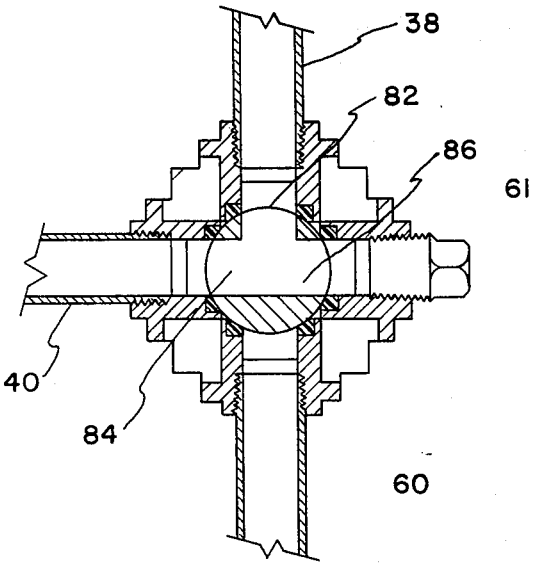
FIGS. 6–9 are sectional views of the valve mechanism herein in respective positions of a sequence of operations.
Figure 7:
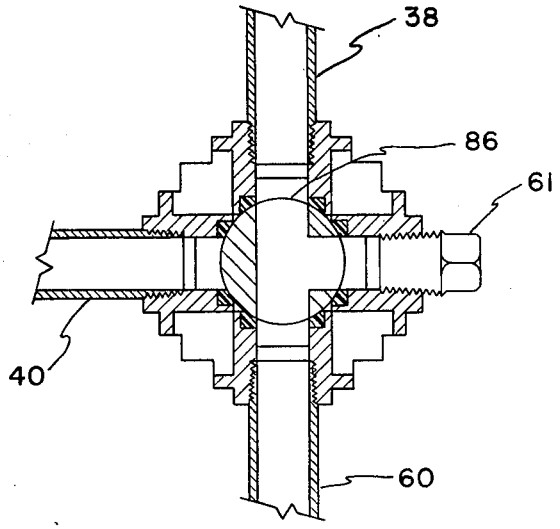

With the structure as described, the ball valve normally rests in the position shown in FIG. 6 with port 82 in communication with the CO outlet 38 and port 84 in communication with the reentry pipe 40. The remaining port 86 of the ball passage is blocked by the cross plug 61. With the valve in this position, flow from the CO pipe can reenter the boiler for normal operation.

When it is desired to blow down the boiler piping, the shaft handle is grasped and the handle is rotated to rotate the shaft. As the shaft leaves the normal position, the off normal limit switch 130 operates to interrupt power to boiler feed supply and/or burner.

As the shaft rotates, it rotates the ball valve. The ratcheting effect of the detent on the square cam causes the valve to enter the position of FIG. 7 for direct blow down of the pipe 38 from the CO control to the drain of blow down pipe 60. In this setting, the handle pointer indicates the position of the valve as 90° from the normal position. The full boiler pressure may be used to blow down this path through the valve ports.

Figure 8:
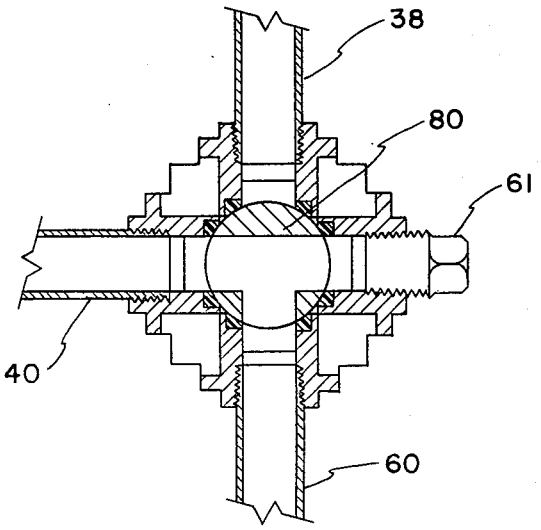

Rotating the valve through a further 90° angular rotation places the reentry pipe in a blow down position communicating with drain pipe 60, the position of FIG. 8. In this position again, the detent has ratcheted the shaft to the position 90° removed from the position FIG. 7. The full boiler pressure may now be used to blow down this path.

Figure 9:
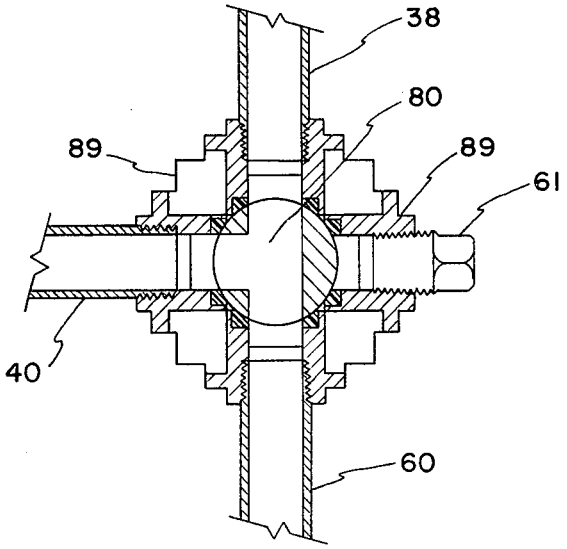

The rotation of the shaft through the next 90° rotation places the valve in the position of FIG. 9, in which both the reentry pipe and the CO outlet pipe are in communication with the drain pipe, so that both pipes may be blown down simultaneously.

The final rotation completes the sequence by restoring the valve to the normal position of FIG. 6. The limit switch restores so that normal operation of the boiler may be undertaken.

Figure 14:
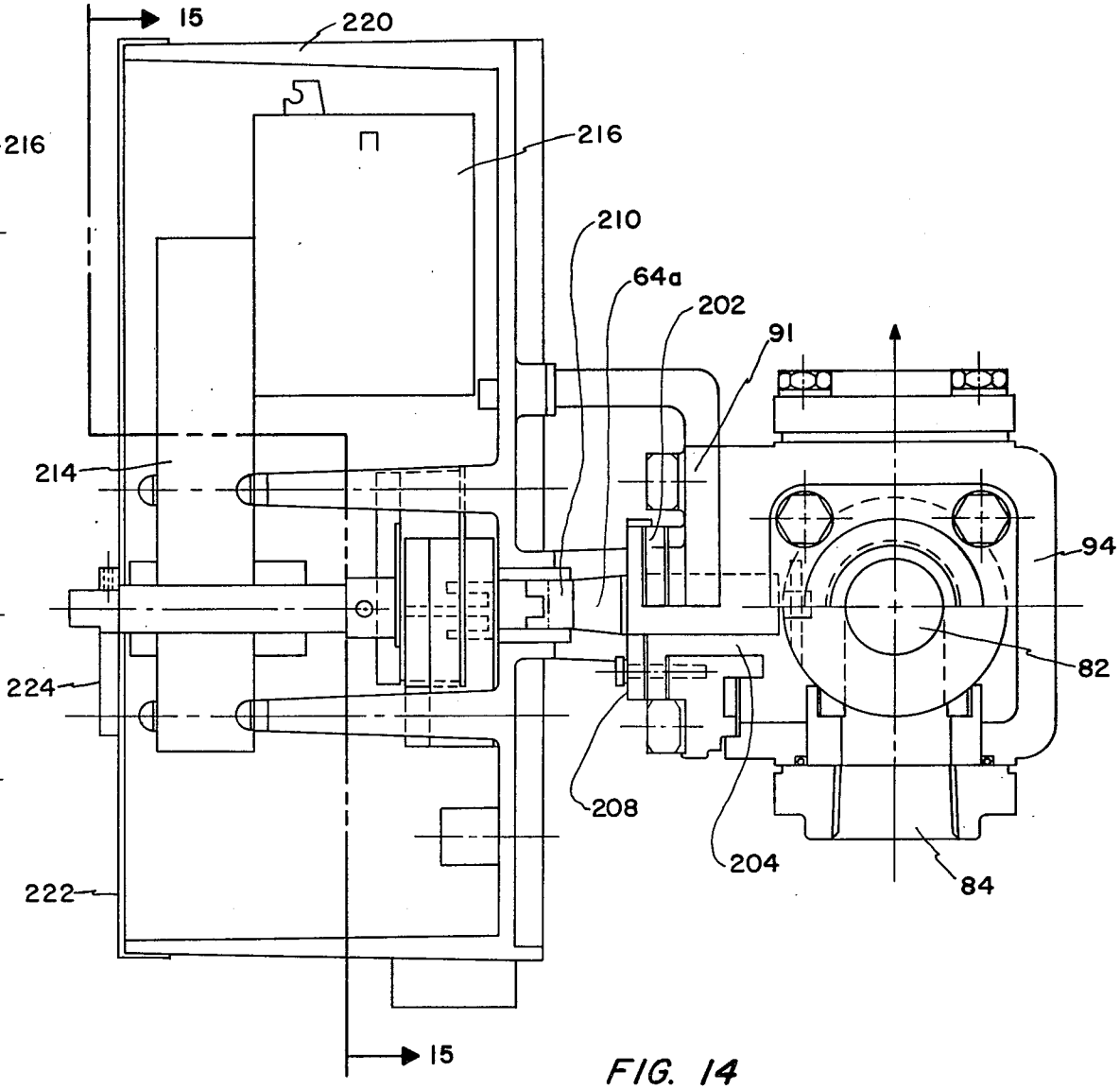
FIG. 14 shows a view similar to FIG. 4 of a valve mechanism adapted for automatic sequencing.

In FIG. 14 is shown the structure of a valve mechanism for automatic motor driven operation and control. The valve structure itself is virtually identical to that of the mechanical embodiment. In FIG. 14, there can be seen the valve cover plate 91 with its bolts secured to the back wall 94, and the valve ports 82 and 84 to the CO outlet and to the reentry pipe respectively. For motor driven operation, the packing gland of the manual embodiment is replaced by the rotary seal 202. A rotary seal 202 is bolted to the outside of the valve cover plate 91 to seal the shaft accordingly. A sleeve bearing 304 surrounds the shaft with a gasket 206 and cover seal 208 completing the valve shaft enclosure. It should be noted that this shaft sealing arrangement of FIGS. 14 and 15 could also be used for the manually operated valve of FIGS. 1–5.

Figure 15:
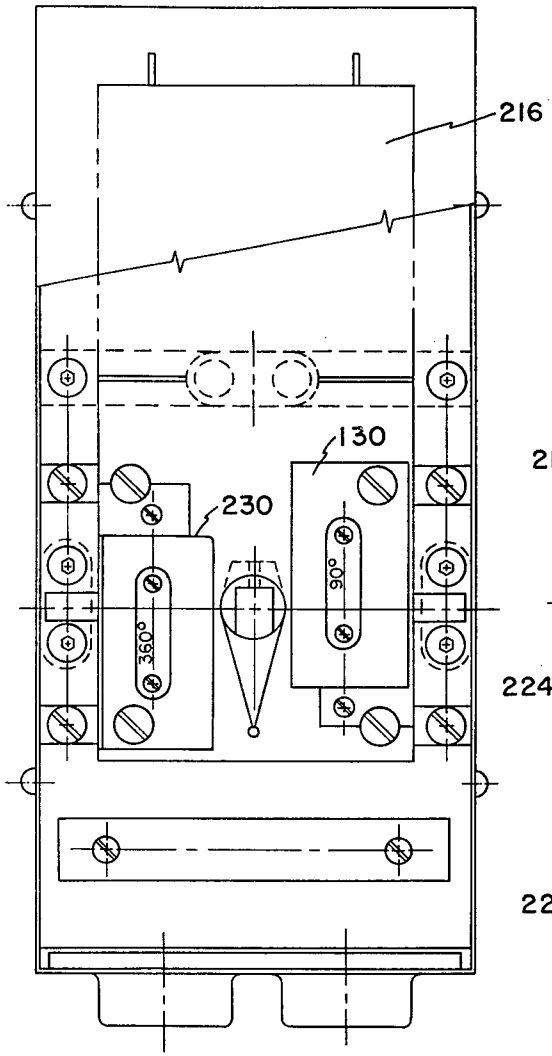
FIG. 15 is a section view along line 15—15 of FIG. 14.

The shaft 64*a* for the embodiment of FIGS. 14 and 15 has a splined or keyed joinder 210 to the shaft 212. Again the joinder of shaft to valve is a keyed fit which can only be secured in one direction to prevent the possibility of incorrect positioning of the valve on the shaft. Shaft 212 is the output of a gear box 214 driven by a high torque low speed AC motor 216. The motor 216 is located within a motor enclosure 220, the enclosure having a face plate 222 with indicia for the shaft pointer 224. The motor is operated in one direction only so that the valve can be sequenced in one direction only.

Figure 10:
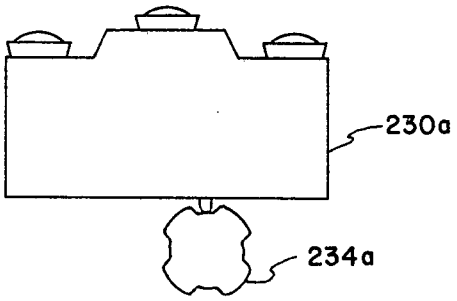
FIGS. 10 and 11 show schematic drawings of two embodiments of a valve position switch usable herein.
Figure 11:
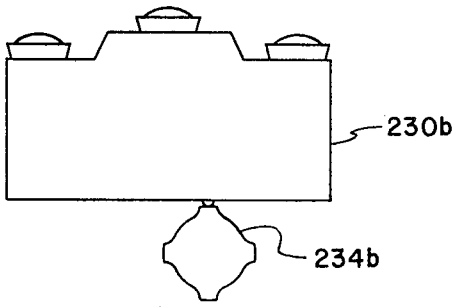

For automatic operation, in addition to the off normal or 360 limit switch 130, a 90° limit switch arrangement is provided. As shown in FIGS. 10 and 11, two versions are shown and either may be used. In FIG. 10, the limit switch 230*a* has a rod switch operator 232 being acted upon by a four lobed cam 234*a*. The cam 234*b* of FIG. 11 is a wheel cam housing four lobes at the respective operating positions.

At each position, the valve configuration and location of the passages are as shown in FIGS. 6–9 and as described previously for the manual mode of operation.

In the automatic mode of operation, the motor is rotated under the control of the 90° cam. When the first blow down position is reached, the motor operation is halted for a dwell or blow down period after which the motor is again energized to step the valve to the next blow down position. After the dwell period which may be set for any period preferably 6 to 20 seconds, the motor is again energized to rotate the valve to the next blow down position and the set dwell period at that position. The motor is again energized to return the valve to its normal operating position. The 360° or off normal limit switch is operated to reenable the burner control circuit.

The circuit may be set for a sequence to operate at any desired interval which may be eight hours for a boiler used constantly, every 24 hours for a boiler operated only for one shift per day. The blow down sequence described would recur at each interval period and would disable the burner control as soon as the valve moved off normal. The burner control would remain disabled through the blow down sequence including the three blow down cycles with a dwell period at each position and a return to the normal position.

The present valve mechanism has been shown in an equalizing network including a cut off control alone or in combination with water glass for visual level evaluation. In some known systems, as many as three equalizing networks may be provided, a first for a water glass, a second for a low water cut off boiler feed and burner control and a third as a secondary low water cut off.

Each such network is provided with a drain tube and a drain valve outside the respective networks. In such a system, each network could be equipped with its own valve mechanism of the type disclosed and claimed herein.

What is claimed is:

1. A blow down apparatus for a commercial steam boiler equipped with an equalizing network comprising a steam pipe from the boiler to the network, a network intermediate line, a network return line from the network to the boiler, and a blow down line from a junction between the network intermediate line and the network return line, the invention comprising a unitary sequencing valve at said junction, means for sequencing said valve from a normal operative position enabling communication between said network line and said return line disabling flow from the network to the blow down line, to respective blow down positions placing said blow down line in open communication with the respective network lines in a sequence, said valve comprising a member having a passage therein, and in which said sequencing means comprises means for rotating positioning said valve member to said respective positions, and for returning said valve member to the normal position to terminate said sequence in which said valve member comprises a ball having a T-shaped passage therein, and in which said valve ball is affixed to a rotatable shaft normal to said passages, and in which there is means for rotating said shaft and limiting said motion to unidirectional respective 90° rotative cycles to position the passages of said ball in communication with respective combinations of said lines at the respective positions, means for limiting the rotation of said shaft to one direction and for stopping the rotation of said ball at said positions, and an enclosing housing for said valve, said housing having O rings circumscribing opposite ones of said lines, said rings bearing against said ball to journal said ball for rotation, said rings being cooperative with said ball and said housing for sealing said lines and said ball passages against inadvertant flow therefrom.

2. A blow down apparatus as claimed in claim 1, in which there is a motor drive for rotating said shaft, and in which there is a limit switch for limiting the rotation of said motor to 90° of shaft rotation for each cycle of said sequence.

3. A valve mechanism for the equalizing network of a steam boiler, in which the network includes in series a line from the steam portion of the boiler, a vertical line including a low water cut off device for the boiler and a horizontal recirculating line, leading from the outlet of said device to said boiler below the water cut off level in said boiler and in which there is a drain line extending from the junction of the outlet of the device and the horizontal recirculating line, means mounting said valve mechanism at said junction, said valve mechanism including a horizontal valve operating shaft at said junction and a ported valve affixed to said shaft for rotation thereby, position control means for maintaining said valve in a normal position providing open communication between the vertical line and the horizontal recirculating line through ports of the valve, means for constraining said shaft to unidirectional rotation through respective sequential rotations of 90° to positions respectively porting said network lines to said drain line, through the ports of said valve further position control means for maintaining said valve in each of said positions, and means for providing access to the valve ports for insertion of cleaning members through the valve to the horizontal and lines in certain of said positions other than the normal position, said valve comprises a ball having three ports in a T formation, and in which said access means comprises a plug closure in said mechanism across the valve from said horizontal line, and means operative responsive to said shaft leaving the normal position of the valve to produce an output signal, said signal producing means terminating said output signal only when said shaft returns to the normal position of the valve.

4. A valve mechanism for use in the equalizing network piping of a commercial steam boiler in which the network is equipped with water level means, in which the network piping includes a vertical outlet line from the water level means joined to a horizontal return line to the boiler and in which there is a vertical drain line extending downwardly from the junction of the outlet line and the return line, a valve housing containing a valve at said junction, said valve having a spherical ball valve therein rotatable about a substantially horizontal axis therethrough, a plurality of valve ports with a fluid passage through said valve housing joining said ports to enable the passage of fluid through the valve, said ports and said passage being perpendicular to the axis of said valve, a shaft on the axis of said valve for rotating said valve, means for controlling the rotation of said valve to steps of 90° of angular rotation with said steps positioning said ports in alignment with at least two of the lines to enable fluid passage between the two aligned lines, said valve in a first rotative position enabling fluid flow through the valve passage between the outlet line and the horizontal return line while blocking flow to the drain line, said valve in further rotative positions enabling fluid flow from successive ones of said network lines to said drain line while blocking flow from any other of said network lines and means for disabling said boiler with said valve in said further rotative positions, said fluid passage through the ball valve comprises a tee passage with three ports therein, and in which said valve housing includes a removable closure member opposite one of said network pipes to permit unencumbered communication with said one pipe through the valve passage with said closure member removed and said valve in certain of said positions and rotation controlling means comprises a four cornered cam mounted for rotation of said shaft, and a one way, spring-loaded ratchet detent cooperative with a corner of said cam at one location for stopping said cam, said shaft and said valve at a 90° end of the cam to said shaft movement.

5. A valve mechanism as claimed in claim 4, in which there is a motor for rotating said shaft and the valve.

6. A valve mechanism as claimed in claim 4, in which there is a manually operable handle for rotating said shaft.

7. A valve mechanism as claimed in claim 4, in which there are a plurality of ring seals supporting said ball in said housing, with a ring seal surrounding each of the port positions of the valve.

8. A valve mechanism as claimed in claim 4, in which there is means operative with said valve out of said first rotative position for causing disabling of the operation of the boiler.

* * * * *